US009446508B2

(12) United States Patent
Dhillon

(10) Patent No.: US 9,446,508 B2
(45) Date of Patent: Sep. 20, 2016

(54) STORED ENERGY STAPLER

(71) Applicant: ACCO Brands Corporation, Lake Zurich, IL (US)

(72) Inventor: Randeep S. Dhillon, Grayslake, IL (US)

(73) Assignee: ACCO Brands Corporation, Lake Zurich, IL (US)

( * ) Notice: Subject to any disclaimer, the term of this patent is extended or adjusted under 35 U.S.C. 154(b) by 432 days.

(21) Appl. No.: 14/098,996

(22) Filed: Dec. 6, 2013

(65) Prior Publication Data

US 2015/0158161 A1 Jun. 11, 2015

(51) Int. Cl.
*B25C 5/11* (2006.01)
*B25C 5/16* (2006.01)

(52) U.S. Cl.
CPC ..... *B25C 5/11* (2013.01); *B25C 5/161* (2013.01); *B25C 5/1617* (2013.01)

(58) Field of Classification Search
CPC ..... B25C 5/11
USPC ..... 227/8, 132
See application file for complete search history.

(56) References Cited

U.S. PATENT DOCUMENTS

| | | | | |
|---|---|---|---|---|
| 1,967,064 | A | | 7/1934 | Polzer et al. |
| 2,109,203 | A | | 2/1938 | Spencer |
| 2,137,642 | A | | 11/1938 | Cavanagh |
| 4,126,260 | A | | 11/1978 | Mickelsson |
| 4,450,998 | A | | 5/1984 | Ruskin |
| 4,463,890 | A | | 8/1984 | Ruskin |
| 5,165,587 | A | * | 11/1992 | Marks ..... B25C 5/11 227/132 |
| 5,335,838 | A | | 8/1994 | Harris et al. |
| 5,356,063 | A | | 10/1994 | Perez |
| 5,407,118 | A | | 4/1995 | Marks |
| 5,497,932 | A | | 3/1996 | Brewer et al. |
| 5,664,722 | A | | 9/1997 | Marks |
| 5,699,949 | A | | 12/1997 | Marks |
| 5,765,742 | A | | 6/1998 | Marks |
| 5,816,470 | A | | 10/1998 | Plato et al. |
| 6,145,728 | A | | 11/2000 | Marks |
| 6,918,525 | B2 | | 7/2005 | Marks |
| 7,080,768 | B2 | | 7/2006 | Marks |
| 7,097,086 | B2 | | 8/2006 | Joyce et al. |
| 7,118,019 | B2 | | 10/2006 | Marks |
| 7,121,444 | B2 | | 10/2006 | Joyce |
| 7,124,924 | B2 | | 10/2006 | Marks |
| 7,178,709 | B2 | | 2/2007 | Marks |
| 7,216,791 | B1 | | 5/2007 | Marks |

(Continued)

FOREIGN PATENT DOCUMENTS

| | | |
|---|---|---|
| BE | 873311 A7 | 5/1979 |
| CH | 301527 A | 9/1954 |

(Continued)

*Primary Examiner* — Nathaniel Chukwurah
(74) *Attorney, Agent, or Firm* — Michael Best & Friedrich LLP

(57) ABSTRACT

A stored energy stapler includes a base portion and a first lever pivotally coupled to the base portion. The first lever includes a front end and a back end. The stapler also includes a second lever pivotally coupled to the base portion about a pivot point, the second lever having a front end and a back end, and a striker element at the front end for driving a staple out of the stapler. The stapler also includes a biasing member coupled to both the first lever and the second lever that biases the back ends of the first and second levers apart from one another. The pivot point is disposed between the striker element and the biasing member.

22 Claims, 12 Drawing Sheets

(56) References Cited

U.S. PATENT DOCUMENTS

| | | | |
|---|---|---|---|
| 7,222,768 | B2 | 5/2007 | Marks |
| 7,234,621 | B2 | 6/2007 | Marks |
| 7,243,832 | B2 | 7/2007 | Jiang |
| 7,299,960 | B1 | 11/2007 | Marks |
| 7,328,827 | B2 | 2/2008 | Marks |
| 7,395,955 | B2 | 7/2008 | Zins et al. |
| 7,404,507 | B2 | 7/2008 | Marks |
| 7,464,844 | B2 | 12/2008 | Kamins et al. |
| 7,540,400 | B2 | 6/2009 | Zins et al. |
| 7,648,054 | B2 | 1/2010 | Marks |
| 7,681,771 | B2 | 3/2010 | Kandasamy et al. |
| 7,703,652 | B2 | 4/2010 | Shen |
| 7,708,179 | B2 | 5/2010 | Marks |
| 7,748,589 | B2 | 7/2010 | Marks |
| 7,823,759 | B2 | 11/2010 | Jiang |
| 7,828,184 | B2 | 11/2010 | Marks |
| 7,909,218 | B2 | 3/2011 | Jiang |
| 7,950,558 | B2 | 5/2011 | Marks |
| 8,052,022 | B2 | 11/2011 | Marks |
| 8,061,575 | B2 | 11/2011 | Joyce et al. |
| 8,074,854 | B2 | 12/2011 | Hu |
| 8,113,404 | B2 | 2/2012 | Marks |
| 8,118,205 | B2 | 2/2012 | Popowich |
| 8,261,956 | B2 | 9/2012 | Marks |
| 8,348,117 | B2 | 1/2013 | Marks |
| 8,453,903 | B2 | 6/2013 | Marks |
| 8,464,620 | B2 | 6/2013 | Marks |
| 8,511,531 | B2 | 8/2013 | Popowich |
| 8,534,168 | B2 | 9/2013 | Marks et al. |
| 8,550,322 | B2 | 10/2013 | Marks |
| 8,668,128 | B2 | 3/2014 | Marks |
| 8,978,952 | B2 | 3/2015 | Marks |
| 2007/0012745 | A1 | 1/2007 | Jiang |
| 2007/0023474 | A1 | 2/2007 | Smith et al. |
| 2007/0057011 | A1 | 3/2007 | Kandasamy et al. |
| 2007/0187450 | A1 | 8/2007 | Chang |
| 2007/0187451 | A1 | 8/2007 | Chang |
| 2007/0221699 | A1* | 9/2007 | Hsu ..... B25C 5/0242 227/134 |
| 2008/0011808 | A1 | 1/2008 | Melgaard et al. |
| 2008/0149683 | A1 | 6/2008 | Marks |
| 2008/0308599 | A1 | 12/2008 | Marks |
| 2009/0120993 | A1 | 5/2009 | Kandasamy et al. |
| 2011/0073632 | A1 | 3/2011 | Marks |
| 2012/0111917 | A1 | 5/2012 | Popowich |
| 2013/0221057 | A1 | 8/2013 | Zhao |
| 2013/0228607 | A1 | 9/2013 | Marks |
| 2014/0027489 | A1 | 1/2014 | Marks |
| 2014/0069982 | A1 | 3/2014 | Zhao |
| 2014/0203060 | A1 | 7/2014 | Marks |
| 2014/0284369 | A1 | 9/2014 | Yang et al. |

FOREIGN PATENT DOCUMENTS

| | | | |
|---|---|---|---|
| CN | 201023340 | Y | 2/2008 |
| CN | 101168333 | A | 4/2008 |
| CN | 101229736 | A | 7/2008 |
| CN | 201371634 | Y | 12/2009 |
| CN | 101786392 | A | 7/2010 |
| CN | 203330989 | U | 12/2013 |
| EP | 0338996 | B1 | 9/1994 |
| FR | 2925381 | A1 | 6/2009 |
| GB | 767273 | A | 1/1957 |
| GB | 2463871 | A | 3/2010 |
| TW | I266677 | B | 11/2006 |
| TW | 200838657 | A | 10/2008 |
| WO | 2007107687 | A1 | 9/2007 |
| WO | 2008052456 | A1 | 5/2008 |

* cited by examiner

STORED ENERGY STAPLER

BACKGROUND

The present invention relates to staplers, and specifically to desk-top staplers.

Desk-top staplers are typically used in office and home settings to staple two or more sheets of paper together. Desk-top staplers include an elongate base member configured to rest on desk-top or other similar surface, a magazine coupled to the base that holds the staples, and a drive arm coupled to the base. To operate the desk-top stapler a user inserts two or more sheets of paper between the magazine and the base member and then presses on the drive arm, which causes a striking element to press down on one of a plurality of U-shaped staples in the staple magazine, driving the staple through the sheets of paper. An anvil on the base forms and clinches two arms of the U-shaped staple underneath the stack of paper to secure the staple to the paper.

To staple a large number of sheets together often requires a significant level of force by a user, as the legs of the staple must be driven through multiple sheets of paper. If too many sheets of paper are inserted between the magazine and the base, the staple may not pass entirely through the sheets of paper, or the legs of the staple may buckle, causing the stapler to jam and requiring removal of the staple, which can damage the sheets of paper or the stapler and remaining staples.

SUMMARY

In accordance with one construction, a stored energy stapler includes a base portion and a first lever pivotally coupled to the base portion. The first lever includes a front end and a back end. The stapler also includes a second lever pivotally coupled to the base portion about a pivot point, the second lever having a front end and a back end, and a striker element at the front end for driving a staple out of the stapler. The stapler also includes a biasing member coupled to both the first lever and the second lever that biases the back ends of the first and second levers apart from one another. The pivot point is disposed between the striker element and the biasing member.

In accordance with another construction, a stored energy stapler includes a base portion sized and configured to rest on a flat surface. The stapler also includes a top lever pivotally coupled to the base portion about a first pivot point, the top lever including a first latch pin at a back end of the top lever. The stapler also includes a striker lever pivotally coupled to the base portion about a second pivot point, the striker lever having a striker element at a front end of the striker lever and a second latch pin at a back end of the striker lever. The stapler also includes a staple magazine pivotally coupled to the striker lever about the second pivot point, the staple magazine sized and configured to hold a plurality of staples to be driven out of the stapler by the striker lever. The stapler also includes a compression spring coupled to both the back end of the striker lever and the back end of the top lever that biases the back ends of the striker lever and the top lever apart from one another. The stapler also includes a latch mechanism pivotally coupled to the base portion for rotation between a secured position and a released position, the latch mechanism including a cam surface sized and configured to be engaged by the first latch pin to move the latch mechanism into the released position, and a notch for holding and retaining the second latch pin when the latch mechanism is in the secured position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-14 illustrate a stored energy stapler 10. The stapler 10 is sized and configured for use as a desk-top stapler. However, the stapler 10 may have various sizes and shapes, and may be used for purposes other than a desk-top stapler.

Figure 1:
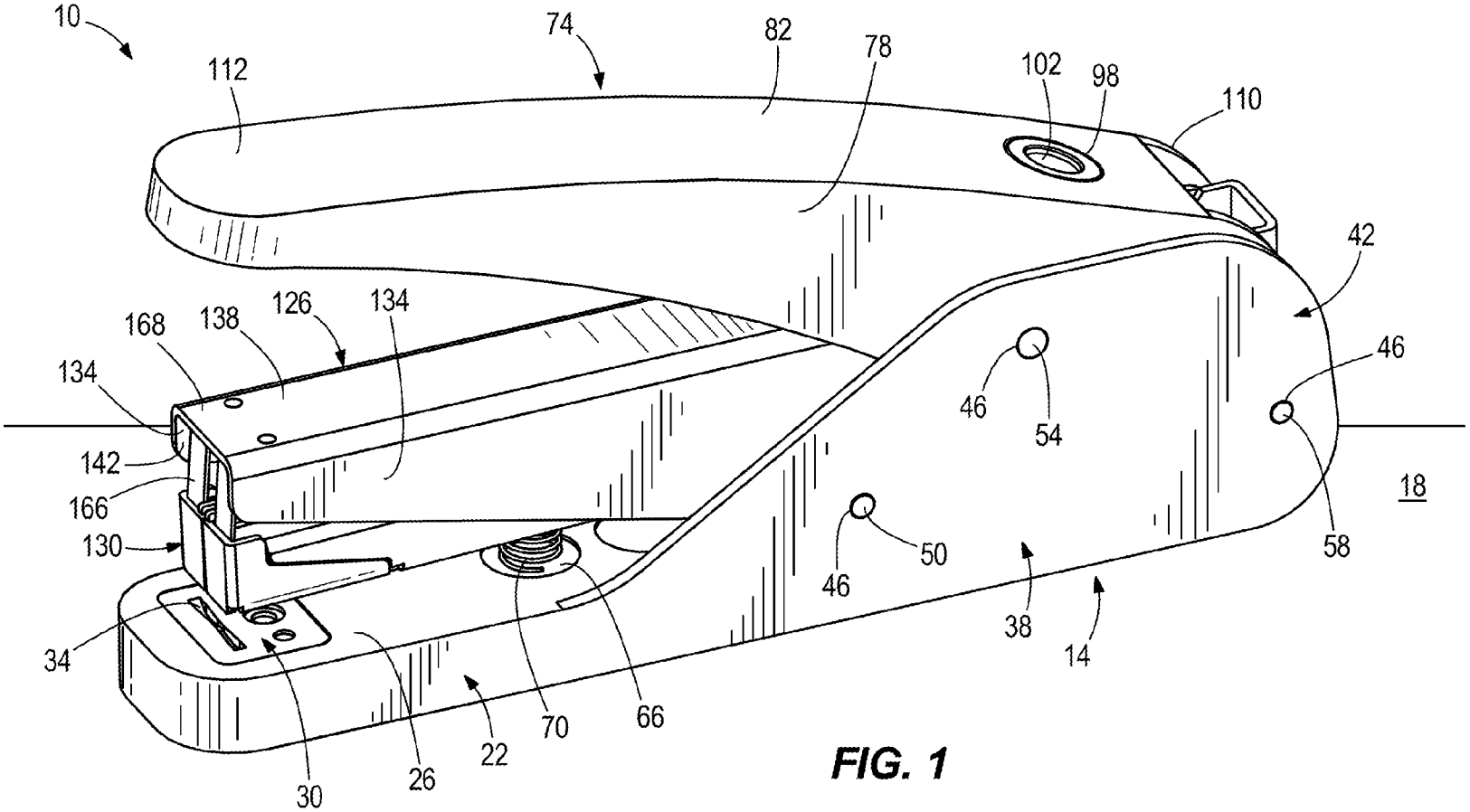
FIG. 1 is a front perspective view of a stapler according to one construction of the invention, resting on a flat surface.
Figure 2:
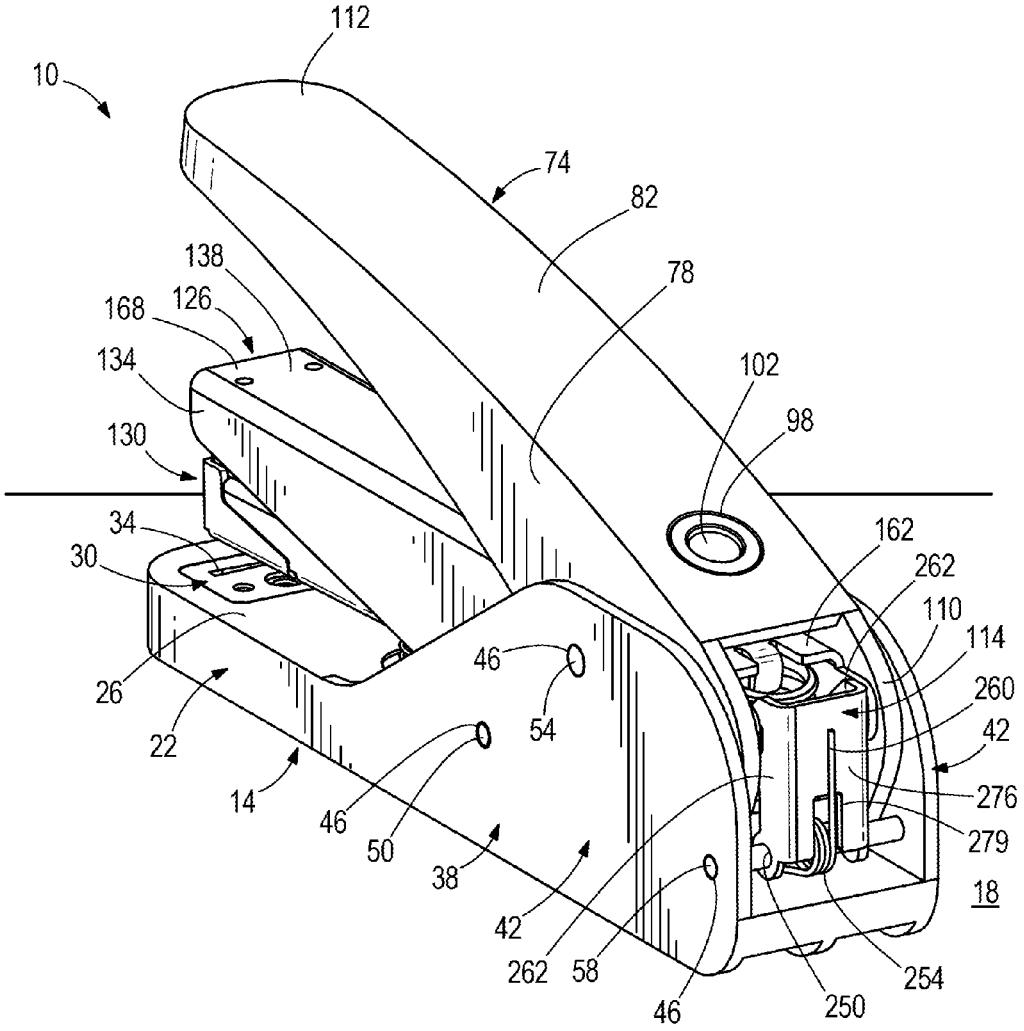
FIG. 2 is a back perspective view of the stapler.
Figure 3:
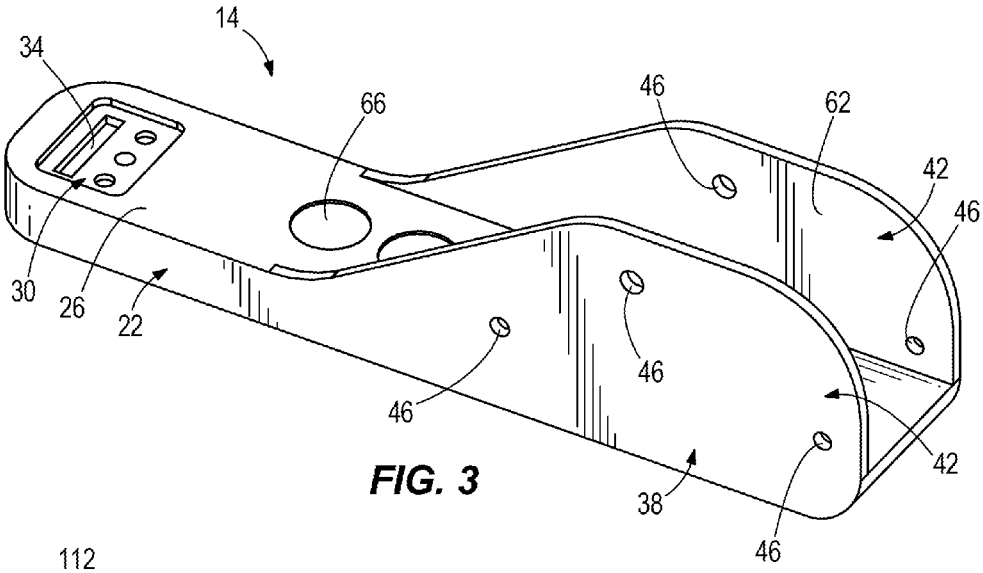
FIG. 3 is a perspective view of a base portion of the stapler.

With reference to FIGS. 1-3, the stapler 10 includes a base portion 14 sized and configured to rest on a flat surface 18. The base portion 14 includes a first region 22 disposed at a front of the base portion 14 for receiving a stack of material (e.g., two or more sheets of paper). The first region 22 includes a generally flat, upper surface 26 to support the stack of material, as well as an anvil 30. The anvil 30 includes at least one grooved area or well 34 for receiving ends of a staple that have passed through the stack of material, and for clinching the ends of the staple together to secure the staple to the stack of material.

With continued reference to FIGS. 1-3, the base portion 14 includes a second region 38 disposed at a back of the base portion 14 for pivotally engaging one or more components of the stapler 10. The second region 38 includes two sidewalls 42 that extend parallel to one another on opposing sides of the stapler 10. Each sidewall 42 includes a plurality of apertures 46 for receiving pivot pins 50, 54, and 58 (FIGS. 1 and 2) that pivotally engage the base portion 14 to the one or more components and define pivot points on the stapler 10. In other embodiments, the pivot points need not be defined by the pins 50, 54, and 58, but instead can be formed in other manners, such as via mating projections and detents formed in the various components. The sidewalls 42 in the illustrated construction each include three apertures 46, although other constructions include different numbers of apertures 46. As illustrated in FIG. 3, the sidewalls 42 form a receiving area 62 between the sidewalls 42 for receiving the one or more additional components, as well as the pivot pins 50, 54, and 58.

The base portion 14 also includes at least one recessed area 66 along the upper surface 26 for receiving the end of a biasing member 70 (FIG. 1). The biasing member 70 is a compression spring, although other constructions include different biasing members 70. The illustrated area 66 is circular in shape, although other constructions include different shapes. In some constructions the area 66 is raised, as opposed to recessed, or is generally flush with the upper surface 26.

Figure 4:
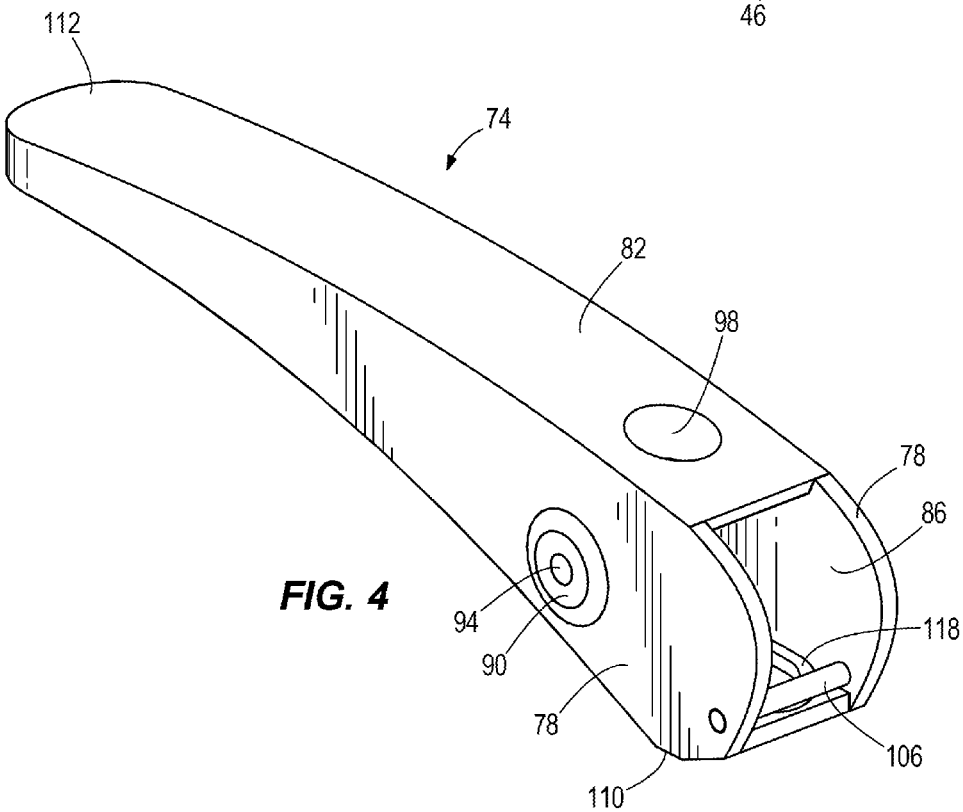
FIG. 4 is a perspective view of a top lever of the stapler.

With reference to FIGS. 1, 2, and 4, the stapler 10 includes a top lever 74 pivotally coupled to the base portion 14. The illustrated lever 74 is a handle for the stapler 10, although in some constructions the lever 74 is disposed beneath a separate handle (not shown). As illustrated in FIG. 4, the lever 74 includes two side portions 78 and a top portion 82 connecting the two side portions 78. The two side portions 78 and the top portion 82 form a generally hollow interior space 86 between the side portions 78. Each of the side portions 78 extends generally perpendicular to the top portion 82, and parallel to the other side portion 78. Each of the side portions 78 includes a raised area 90 extending away from the opposing side portion 78, and having an aperture 94 extending therethrough. As illustrated in FIGS. 1-4, the pivot pin 54 passes through the aperture 94, as well as one of the apertures 46, to pivotally engage the lever 74 to the base portion 14.

With continued reference to FIGS. 1, 2, and 4, the lever 74 also includes an opening 98 along the top portion 82 for receiving an activation member 102 (FIG. 1). The opening 98 extends entirely through the top portion 82.

Figure 11:
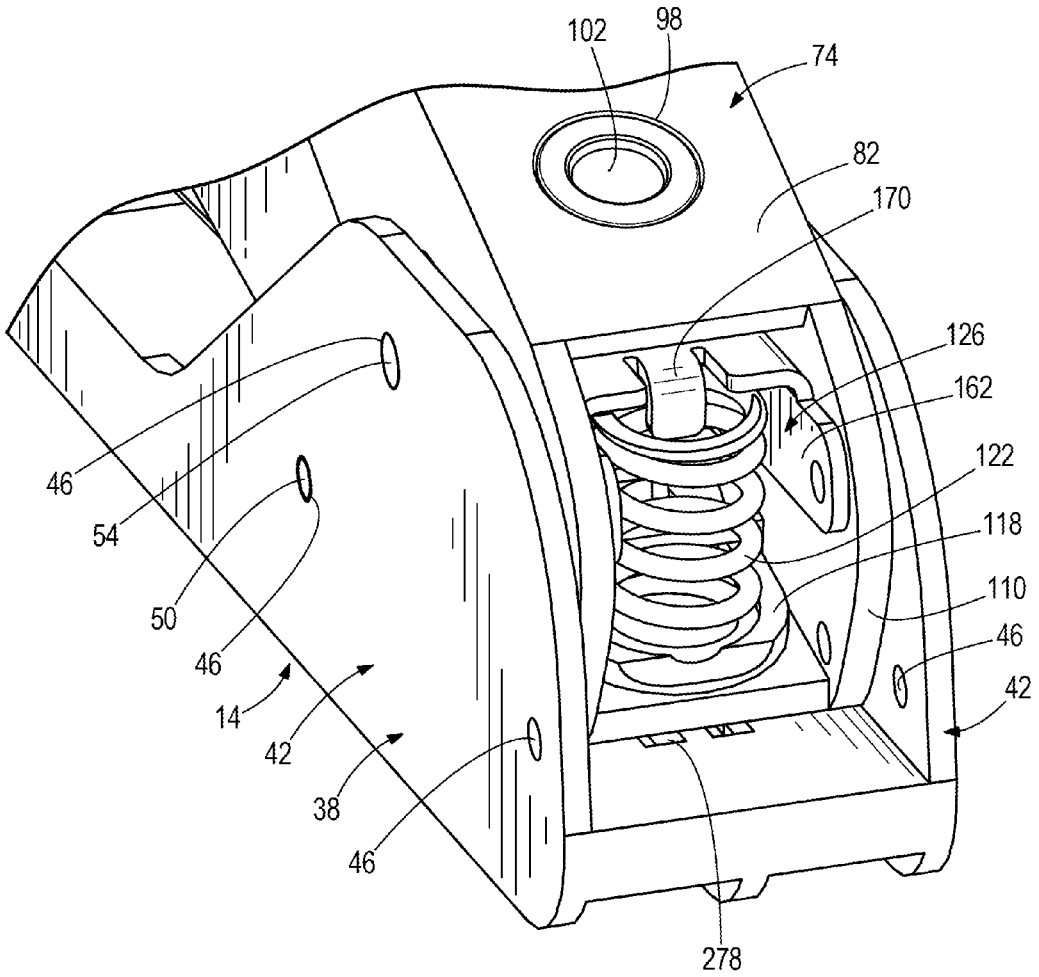
FIG. 11 is a partial, perspective view of the back of the stapler, with the latch mechanism removed.

With continued reference to FIGS. 2, 4, and 11 the lever 74 also includes a latch pin 106 extending between the two side portions 78 at a back end 110 of the lever 74 that is opposite a front end 112 of the lever 74. The illustrated latch pin 106 is circular in cross-section. However, other constructions include cross-sectional shapes other than that illustrated, such as rectangular, oval, etc. Additionally, the latch pin 106 need not be a separate pin, but instead can be integrally formed with the lever 74. As described further herein, the latch pin 106 is sized and configured to engage a latch mechanism 114 (FIG. 2) of the stapler 10.

With reference to FIGS. 4 and 11, the lever 74 also includes a retaining element 118 at the back end 110 of the lever 74 that receives and couples to the end of a biasing member 122 (FIG. 11). The biasing member 122 is a compression spring, although other constructions include different structures for the biasing member 122. The illustrated retaining element 118 is a raised ledge or seat that retains the end of the biasing member 122. Other constructions include different structures for the retaining element 118.

With reference to FIGS. 1, 2, 5, and 6, the stapler 10 further includes a striker lever 126 pivotally coupled to a magazine 130 about the pivot pin 50. The lever 126 and the magazine 130 are pivotally coupled to the base portion 14 about the pivot pin 50, and are both pivotally coupled the lever 74 about the pivot pin 54.

The lever 126 includes two side portions 134 that extend alongside the magazine 130, and a top portion 138 connecting the two side portions 134 above the magazine 130. The two side portions 134 and the top portion 138 form a generally hollow interior space 142 between the side portions 134. Each of the side portions 134 extends generally perpendicular to the top portion 138, and parallel to the other side portion 134.

Figure 5:
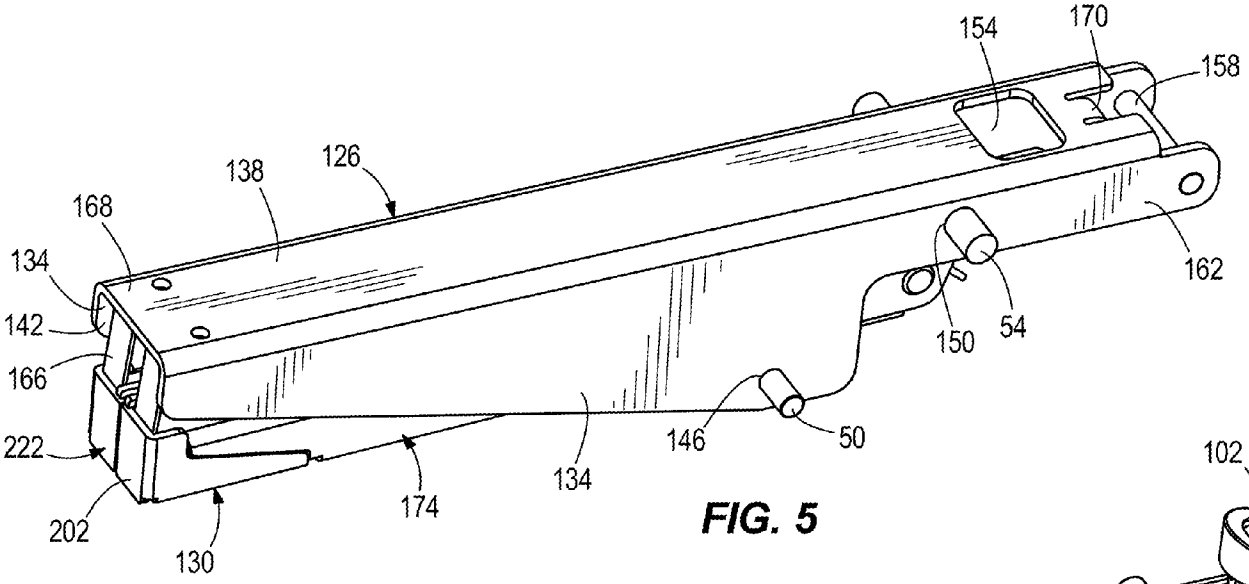
FIG. 5 is a perspective view of a striker lever and magazine of the stapler.
Figure 6:
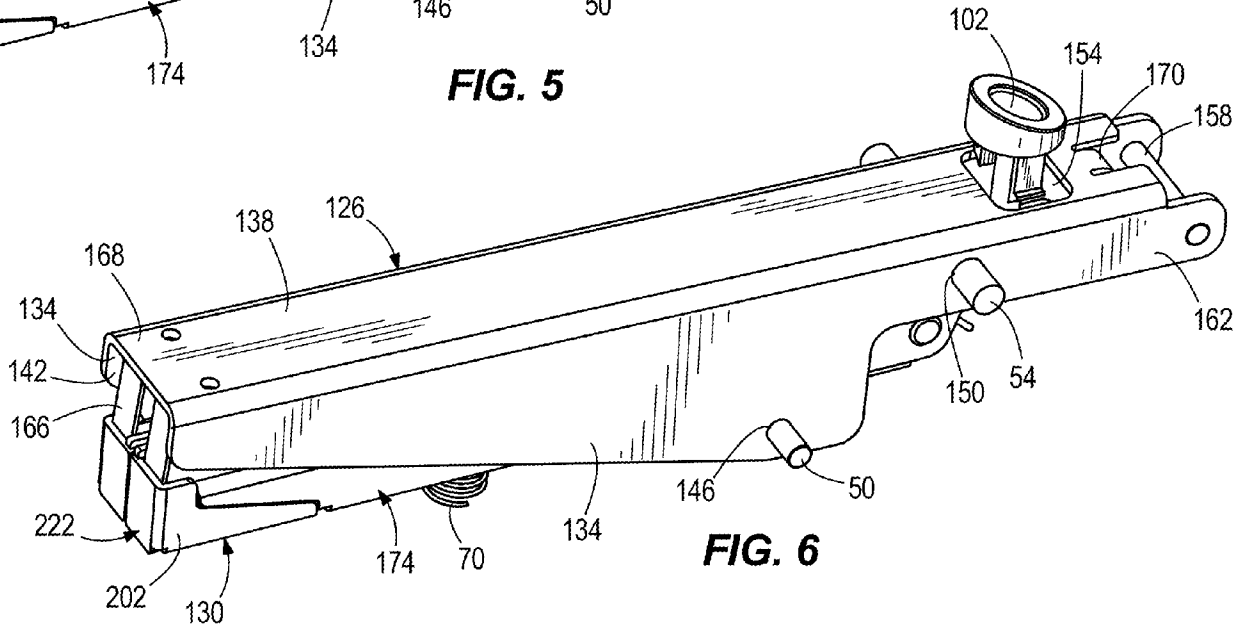
FIG. 6 is a perspective view of the striker lever and magazine, as well as an activation member.

With continued reference to FIGS. 5 and 6, the lever 126 includes apertures 146 on both side portions 134 for receiving the pivot pin 50, and apertures 150 on both side portions 134 for receiving the pivot pin 54. The lever 126 further includes an opening 154 disposed on the top portion 138 for receiving the activation member 102 (FIG. 6). The opening 154 is generally aligned with the opening 98 on the lever 78.

As illustrated in FIGS. 5 and 6, the lever 126 also includes a latch pin 158 extending between the two side portions 134 at a back end 162 of the lever 126. The illustrated latch pin 158 is circular in cross-section. However, other constructions include cross-sectional shapes other than that illustrated, such as rectangular, oval, etc. Additionally, the latch pin 158 need not be a separate pin, but instead can be integrally formed with the lever 126. As described further herein, the latch pin 158 is sized and configured to engage the latching mechanism 114.

With continued reference to FIGS. 5 and 6, the lever 126 also includes a striker element 166 at a front end 168 of the lever 126. The striker element 166 is sized and configured to extend into the magazine 130 and drive a staple out of the magazine 130 and toward the anvil 30.

With reference to FIGS. 5, 6, and 11, the lever 126 also includes a retaining element 170 at the back end 162 of the lever 126. The retaining element 170 is a hooked flange, although other constructions include different structures for the retaining element 170. As illustrated in FIG. 11, an end of the biasing member 122 is coupled to and retained by the retaining element 170, such that the retaining elements 118, 170 engage opposing ends of the biasing member 122. The biasing member 122 presses and expands against the retaining elements 118, 170 such that the back end 162 of the lever 126 is biased away from the back end 110 of the lever 74.

Figure 7:
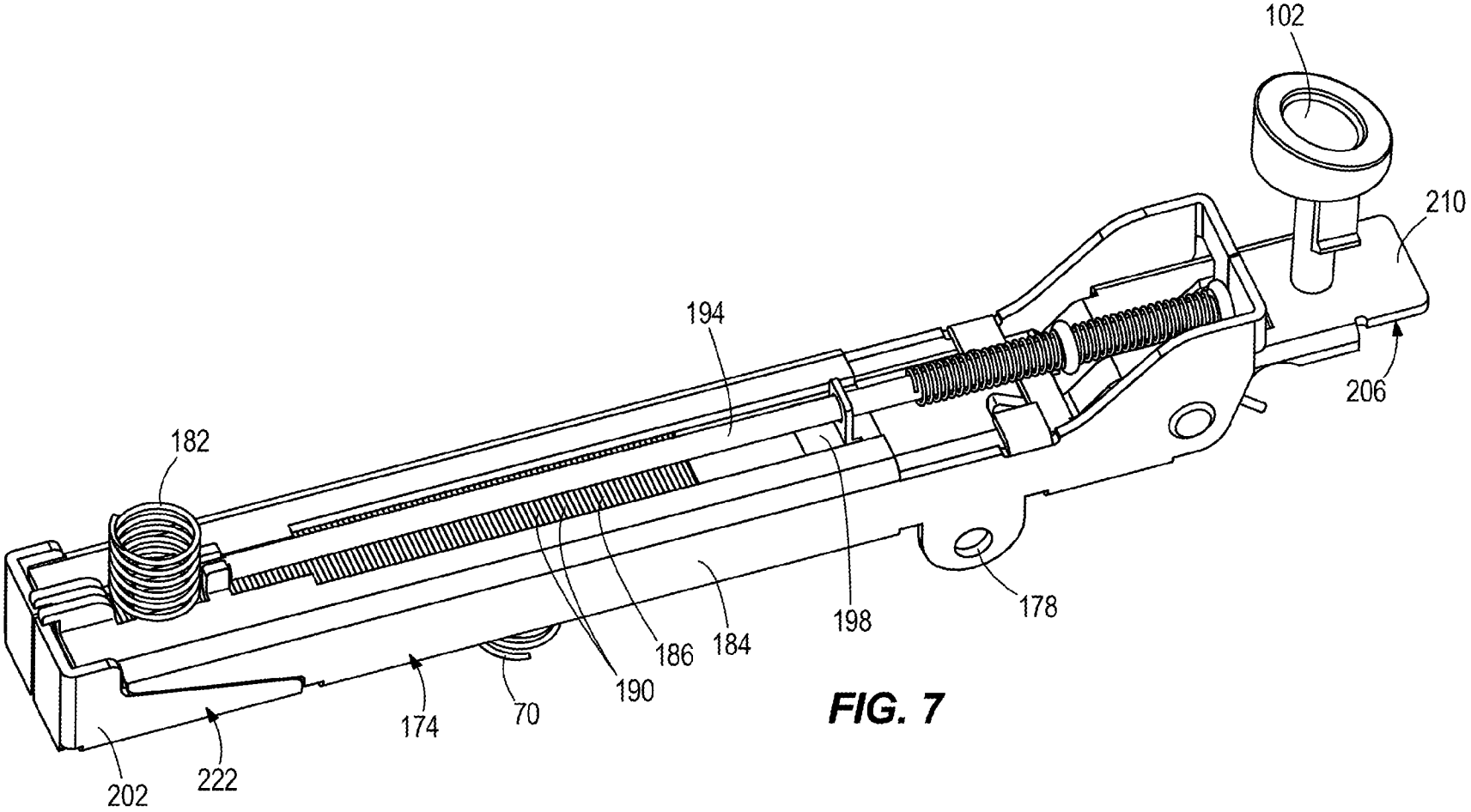
FIG. 7 is a top perspective view of the magazine and activation member.
Figure 8:
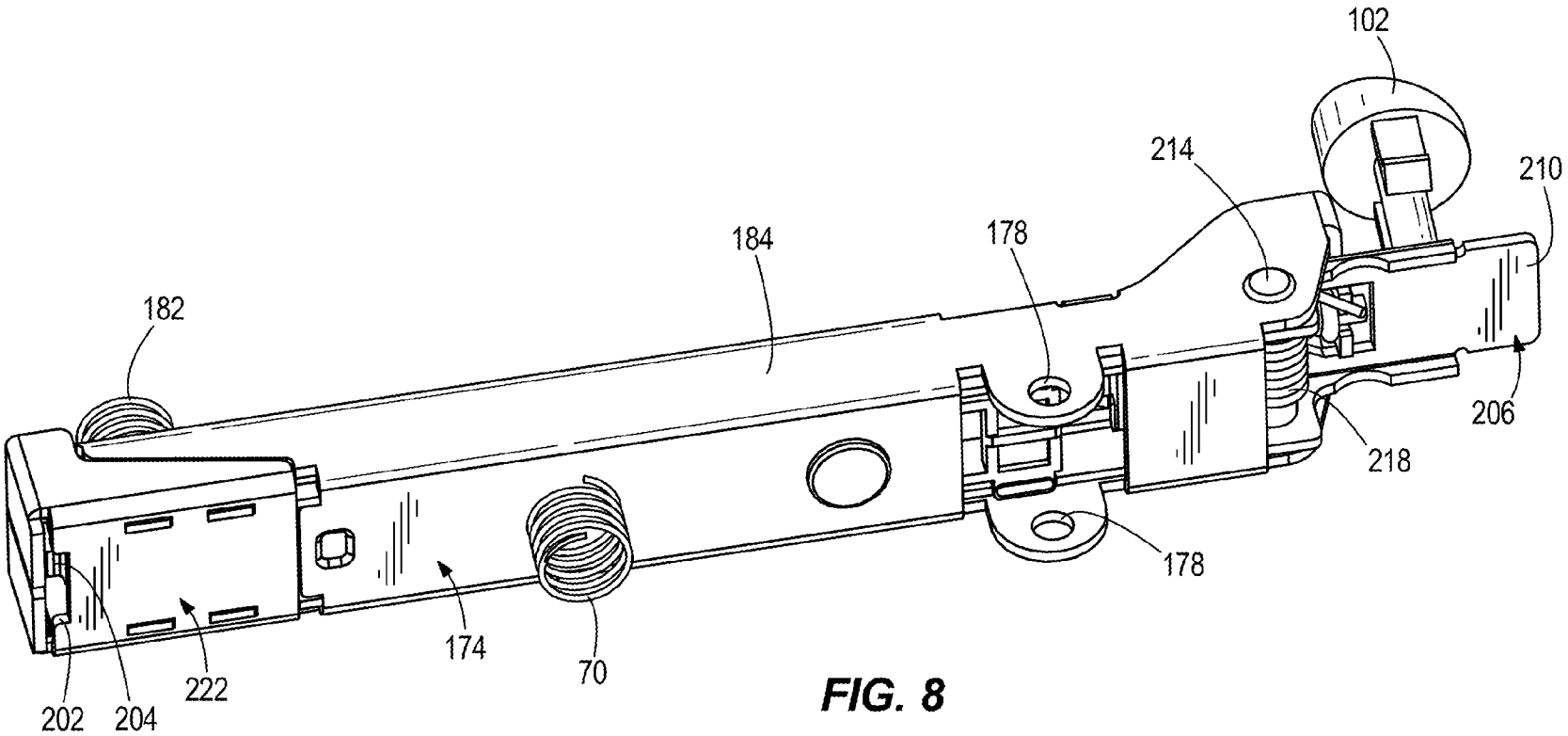
FIG. 8 is a bottom perspective view of the magazine and activation member.

With reference to FIGS. 5-8, the magazine 130 includes a first component 174. As illustrated in FIGS. 7 and 8, the first component 174 includes apertures 178 that receive the pivot pin 50, such that the first component 174 is pivotally movable about the pivot pin 50. The apertures 178 are aligned with the apertures 146 on the lever 126. The pivot pin 50 extends through both the apertures 178 and the apertures 146, such that both the lever 126 and the first component 174 of the magazine 130 are pivotally movable about the pin 50. As illustrated in FIGS. 7 and 8, a biasing member 182 is disposed between and coupled to both the first component 174 and the lever 126. The biasing member 182 is a compression spring, although other constructions include different structures for the biasing member 182. The biasing member 182 biases the first component 174 away from the lever 126, such that a force must be applied downwardly on the front end 168 of the lever 126 to move the striker element 166 toward the first component 174.

With continued reference to FIGS. 5-8, the first component 174 is also coupled to the biasing member 70. The biasing member 70 extends from the first component 174 to the base portion 14, and biases the base portion 14 away from the first component 174, such that a force must be applied downwardly on the first component 174 to move the first component 174 toward the anvil 30.

With continued reference to FIGS. 7 and 8, the first component 174 includes an elongate frame 184 defining a chamber 186 for holding staples 190. The first component 174 also includes a push rod 194 coupled to the frame 184, and a sliding push member 198 coupled to the rod 194 that slides along the rod 194 and biases the staples 190 toward a discharge end 202 of the magazine 130 where the staples 190 are driven out of an opening 204 (FIG. 8).

Figure 9:
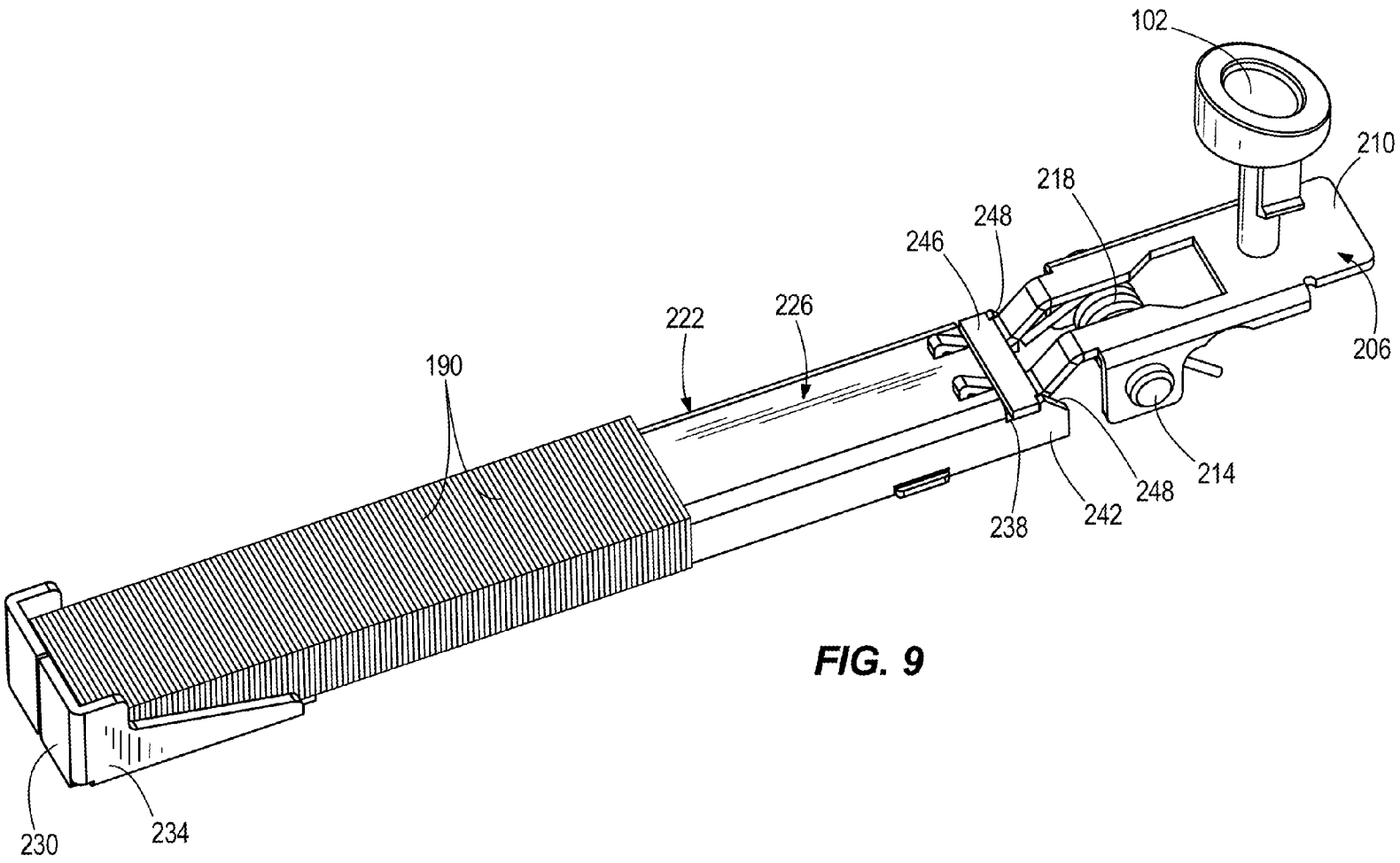
FIG. 9 is a perspective view of a portion of the magazine and activation member.

With reference to FIGS. 7-9, the magazine 130 also includes a second component 206. The second component 206 is a protruding flange along a back end 210 of the magazine 130. The second component 206 is disposed directly below the activation member 102. As illustrated in FIGS. 8 and 9, the second component 206 is pivotally coupled to the first component 174 about a pin 214 that extends through the frame 184. The second component 206 is rotationally biased by a biasing member 218. The biasing member 218 is a torsion spring wrapped around the pin 214, although in other constructions the biasing member 218 includes other structures.

With reference to FIGS. 5-9, the magazine 130 also includes a third component 222. The third component 222 is releasably coupled to the second component 206, and is slidable axially relative to the first component 174.

With reference to FIG. 9, the third component 222 includes a frame 226 that is at least partially nested within the first component 174. The staples 190 rest on the frame 226. The frame 226 includes a stop member 230 at a front end 234 of the frame 226 that prevents the staples 190 from falling out of the magazine 130. The frame 226 also includes a notched portion 238 along a back end 242 of the frame 226. The notched portion 238 receives an engaging member 246 of the second component 206.

As illustrated in FIGS. 1-9, to replace or exchange the staples 190, the activation member 102 is pressed down through the openings 98 and 154 until the activation member 102 contacts the second component 206. When the activation member 102 contacts the second component 206, the second component 206 is rotated clockwise (as seen in FIG. 9) about the pin 214, and against the biasing force of the biasing member 218, such that the engaging member 246 is lifted out of the notched portion 238 and the third component 222 is freed from the second component 206. The third component 222 is then able to slide axially relative to the first component 174 (i.e., within the frame 184), away from both the first and second components 174, 206 and out of a front of the stapler 10, so that the staples 190 may be replaced or added to the third component 222. In some constructions the stapler 10 includes a biasing member (e.g., spring) that biases the third component 222 away from the first and second components 174, 206. Once the staples 190 are replaced or added, the third component 222 is then pushed back into the frame 184. The notched portion 238 is moved toward the engaging member 246. The third component 222 includes cam surfaces 248 that engage the engaging member 246 as the third component 222 is being pushed into the frame 184. The cam surfaces 248 temporarily lift the engaging member 246 to allow the third component 222 to slide under the engaging member 246. The engaging member then falls back down into the notched portion 238, locking the third component 222 relative to the second component 206.

With reference to FIGS. 2, 10, and 12-14, the stapler 10 is a stored energy stapler that utilizes the biasing member 122 in combination with the latch mechanism 114 and the latch pins 106 and 158 to store potential energy in the biasing member 122, and then convert that potential energy into kinetic energy to drive the staples 190 out of the stapler 10.

Figure 10:
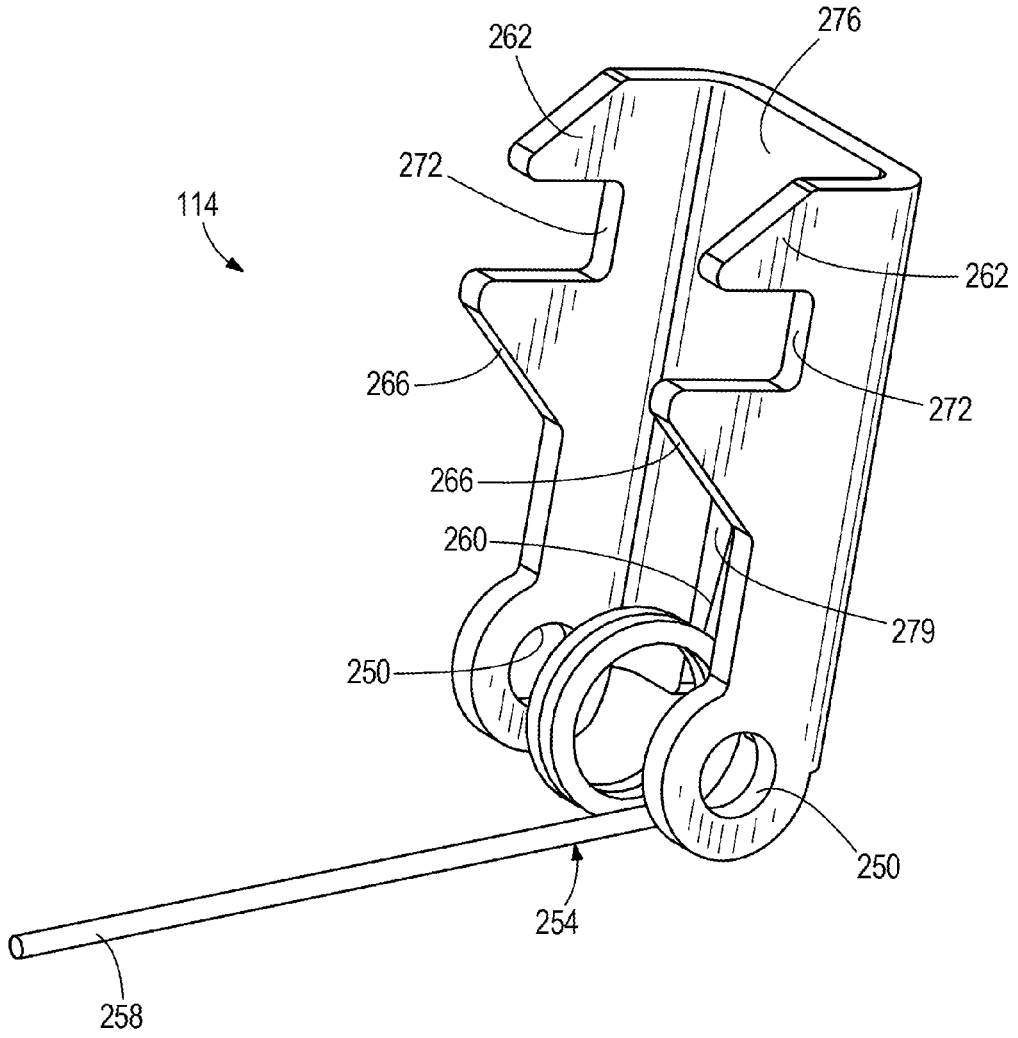
FIG. 10 is a perspective view of a latch mechanism for the stapler.

With reference to FIGS. 2 and 10, the latch mechanism 114 includes apertures 250 that receive the pivot pin 58. The latch mechanism 114 is pivotally coupled to the pivot pin 58. The latch mechanism 114 includes a biasing member 254. The biasing member 254 is a torsion spring that wraps about the pivot pin 58 and includes two ends 258, 260. Other constructions include different structures for the biasing member 254.

With continued reference to FIGS. 2 and 10, the latch mechanism 114 also includes two sidewalls 262 each having a cam surface 266 and a notch or recess 272 disposed above the cam surface 266. The sidewalls 262 are parallel to one another, and are connected with a back wall 276.

The end 258 of the biasing member 254 is coupled to (e.g., fixedly attached to) the base portion 14, and the end 260 of the biasing member 254 is coupled to (e.g., fixedly attached to) at least one of the walls 262, 276, so that the biasing member 254 is biased in the counterclockwise direction toward a generally upright position as illustrated in FIG. 2. In the illustrated construction the end 258 extends partially into an aperture 278 (as illustrated in FIG. 11), to couple the end 258 to the base portion 14. The end 260 extends through a slot or opening 279 (as illustrated in FIGS. 2 and 11-14) in the wall 276 and rests against a back of the wall 276.

Figure 12:
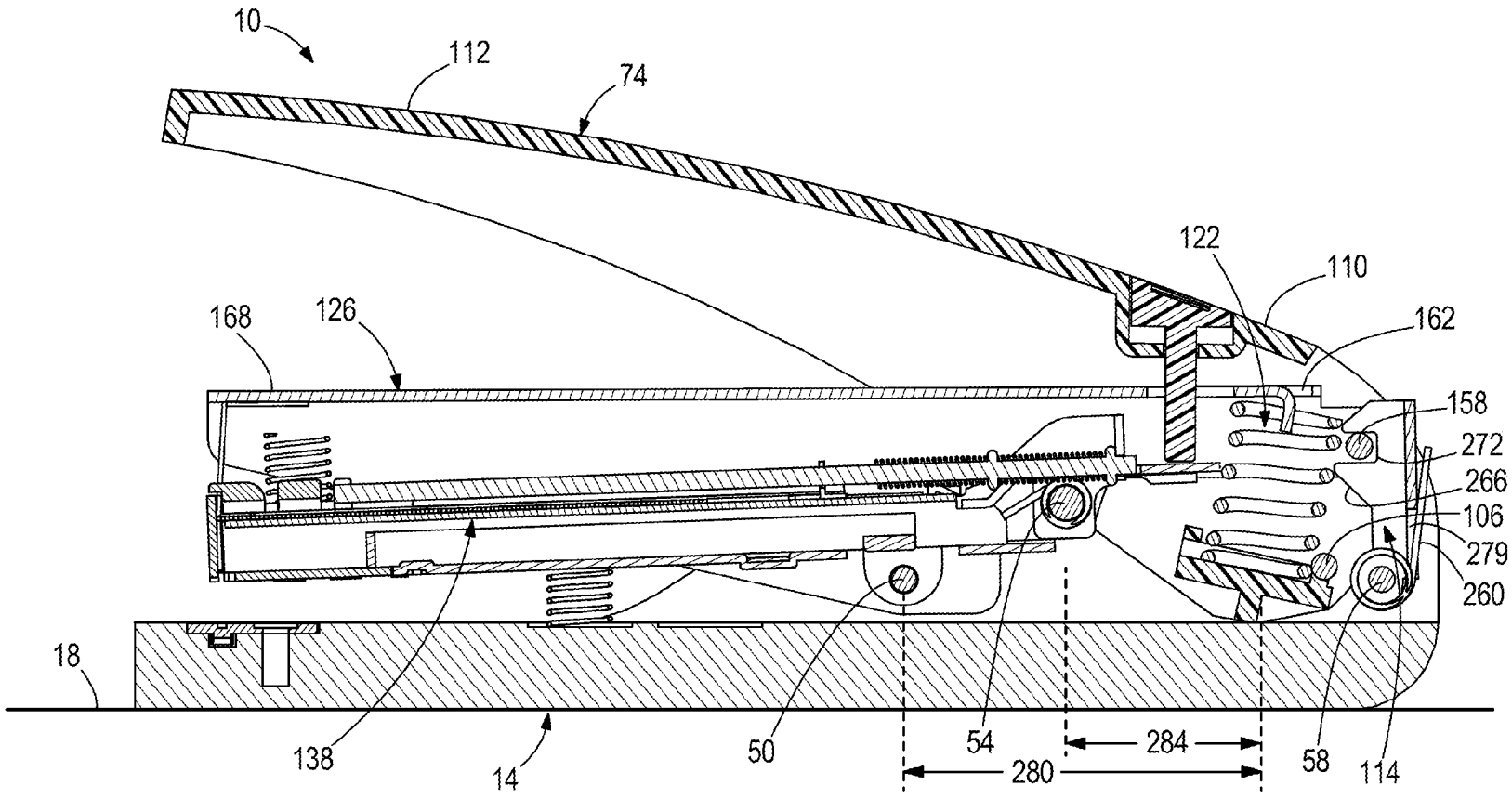
FIG. 12 is a section side view of the stapler in a first operating position.
Figure 13:
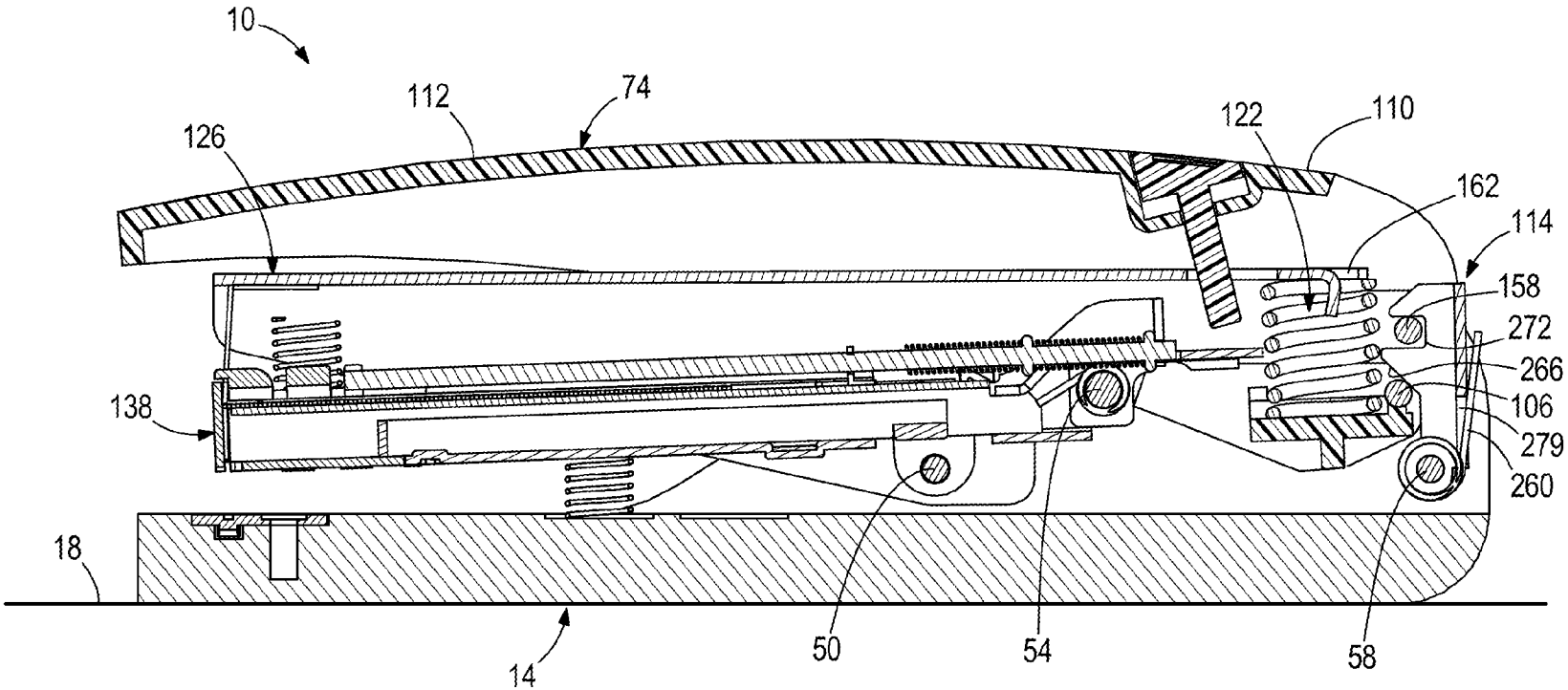
FIG. 13 is a section side view of the stapler in a second operating position.
Figure 14:
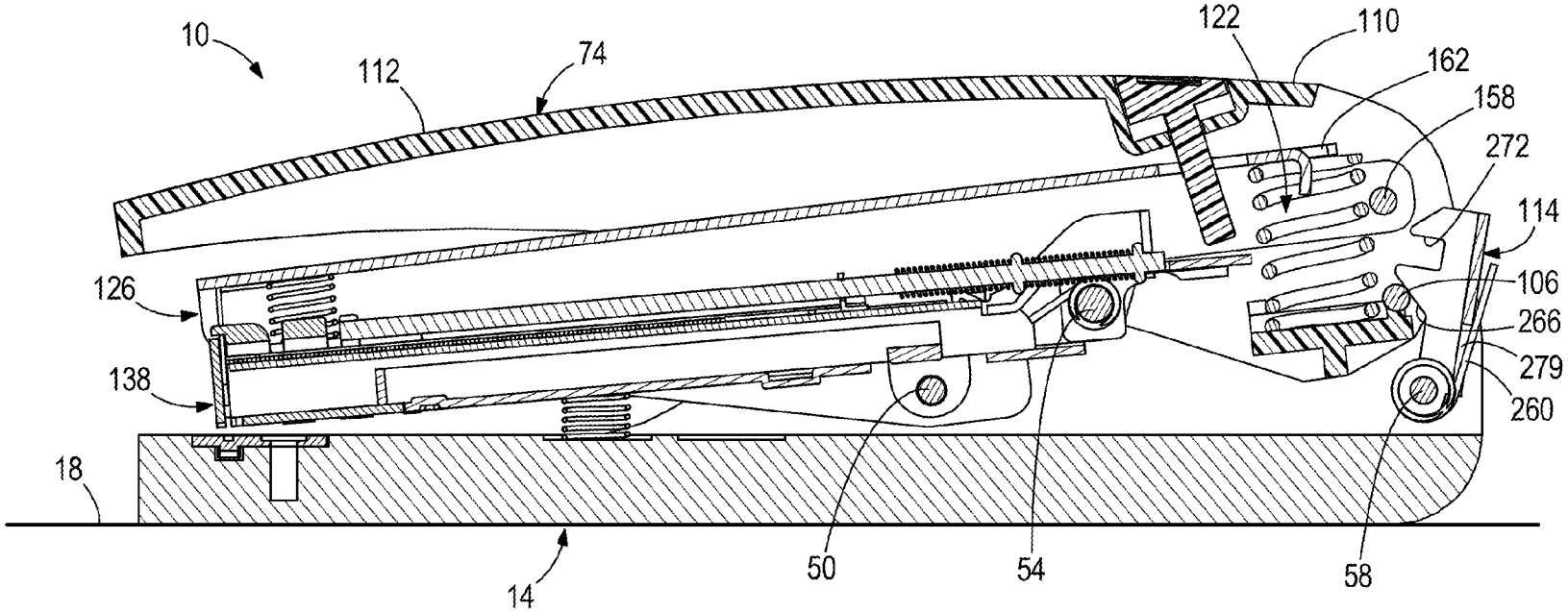
FIG. 14 is a section side view of the stapler in a third operating position.

With reference to FIGS. 12-14, the cam surfaces 266 are sized and configured to engage the latch pin 106 on the top lever 74, and the notches 272 are sized and configured to receive and engage the latch pin 158 on the striker lever 126.

With reference to FIG. 12, with the stapler 10 in a first operating position, the front end 112 of the lever 74 is biased away from the front end 168 of the lever 126, the lever 126 and the magazine 130 are generally parallel to the flat surface 18, and the latch mechanism 114 is in a fully biased, generally upright state. In the first operating position the latch pin 158 is engaged with and received by the notches 272, and the latch pin 106 is disposed away from and below the cam surfaces 266. In the first operating position the biasing members 70, 122, and 182 are relaxed (i.e., are not compressed). In the first operating position the latch mechanism 114 is securely engaged with the lever 126 to prevent the lever 126 from pivoting about the pivot pin 50.

With reference to FIG. 13, with the stapler 10 in a second operating position, a downward force has been applied to the front end 112 of the lever 74 (e.g., by a user pressing down on the lever 74). The lever 74 has rotated counterclockwise about the pivot pin 54, causing the latch pin 106 to begin moving toward the cam surfaces 266 upwardly in FIG. 13. Because the latch pin 158 is still retained within the notches 272, the striker lever 126 does not rotate about the pivot pin 50. Instead, the striker lever 126 remains stationary relative to the base portion 14. The movement of the lever 74 generates a relative movement between the back ends 110, 162 of the top lever 74 and the striker lever 126, respectively, which causes a compression of the biasing member 122. As the lever 74 rotates further, the biasing member 122 similarly compresses further, generating an increased amount of built-up potential energy in the biasing member 122.

With reference to FIG. 14, with the stapler 10 in a third operating position, the downward force has been further applied to the front end 112 of the lever 74 (e.g., by a user continuing to press down on the lever 74). The lever 74 has rotated further counterclockwise about the pivot pin 54, causing the latch pin 106 to engage with the cam surfaces 266. This engagement of the latch pin 106 with the cam surfaces 266 has caused a clockwise rotation of the latch mechanism 114 about the pivot pin 58, which has allowed the latch pin 158 to slide relative to the latch mechanism 114 and be released from the notches 272. The release of the latch pin 158 from the latching mechanism 114 has allowed the potential energy built up in the biasing member 122 to be released, which has generated a counterclockwise rotational movement of the lever 126 about the pivot pin 50. In the third operating position the latch mechanism 114 is out of the secured engagement with the lever 126, creating a released position that allows the lever 126 to pivot about the pivot pin 50.

As the lever 126 pivots in a counterclockwise manner about the pivot pin 50, the striker element 166 is pressed down through the magazine 130 and drives a staple 190 out of the stapler 10.

Once the staple 190 has been driven out of the stapler 10 and the user releases the lever 74, the biasing member 254 biases the latch mechanism 114 back toward the first operating position illustrated in FIG. 12. The latch mechanism 114 receives and engages the latch pin 158 in the notches 272, and the latch pin 106 returns to a position in which the latch pin 106 is disposed beneath the cam surfaces 266 and disengaged with the cam surfaces 266. Once in the first operating position again, the stapler 10 is ready to repeat the positions and steps illustrated in FIGS. 12-14 to drive out another staple 190.

With reference to FIGS. 12-14, the biasing member 122 is disposed rearwardly of the pivot pins 50 and 54, such that the pivot pin 54 is disposed between the pivot pin 50 and the latching mechanism 14. During the operating positions described above, and as illustrated in FIG. 12, the biasing member 122 remains spaced a distance 280 from the pivot pin 50. The distance 280 is measured along an axis perpendicular to the force generated by the biasing member 122, and is equivalent to a moment arm for the torque generated by the biasing member 122 on the striker lever 126 when the latch pin 158 is released. Similarly, the biasing member 122 remains spaced a distance 284 (measured along the same axis as distance 280, or one parallel to the same axis) from the pivot pin 54. The distance 284 measures a moment arm for the torque generated by the biasing member 122 on the top lever 74 when the latch pin 158 is released. The moment arm corresponding to the distance 280 is greater than the moment arm corresponding to the distance 284. The ratio of the distance 284 to the distance 280 is approximately 2.0. In some constructions the ratio is between approximately 1.5 and 2.5. Other constructions include different values and ranges for the ratio.

The moment arms and the relative positions of the pivot pins 50, 54 and biasing member 122 described above create greater torque on the lever 126 than the top lever 74 when the latch pin 158 is released from the latch mechanism 114. This facilitates a strong, downward driving movement of the striker element 166 through the sheets of material positioned on the base portion 14. Additionally, because the biasing member 122 is disposed adjacent the latching mechanism 114, and behind both the pivot pins 50 and 54, the moment arm and torque corresponding to the distance 280 remains significantly larger than if the biasing member 122 were disposed closer to the pivot pin 50, or between the pivot pins 50 and 54. This large distance 280 also facilitates a strong, downward driving movement of the striker element 166.

Various features and advantages of the invention are set forth in the following claims.

What is claimed is:

1. A stored energy stapler comprising:

a base portion;

a first lever pivotally coupled to the base portion, the first lever having a front end and a back end;

a second lever pivotally coupled to the base portion about a pivot point, the second lever having a front end and a back end, and a striker element at the front end for driving a staple out of the stapler; and a biasing member coupled to both the first lever and the second lever that biases the back ends of the first and second levers apart from one another;

wherein the pivot point is disposed between the striker element and the biasing member.

2. The stored energy stapler of claim 1, further comprising a latch mechanism coupled to the base portion and the second lever to selectively prevent rotation of the second lever about the pivot point.

3. The stored energy stapler of claim 2, wherein the biasing member is a first biasing member, and wherein the latch mechanism is rotationally biased by a second biasing member into a secured engagement with the second lever to prevent rotation of the second lever.

4. The stored energy stapler of claim 3, wherein the first biasing member is a compression spring, and the second biasing member is a torsion spring.

5. The stored energy stapler of claim 3, wherein the first biasing member is sized and configured to store energy when the front end of the first lever is pressed toward the base portion, and wherein the first biasing member is configured to release the stored energy when the latch mechanism is rotated out of the secured engagement with the second lever.

6. The stored energy stapler of claim 3, wherein the latch mechanism includes a cam surface and a notch.

7. The stored energy stapler of claim 6, wherein the first lever includes a first latch pin disposed on the back end of the first lever that is sized and configured to engage the cam surface and rotate the latch mechanism out of the secured engagement.

8. The stored energy stapler of claim 7, wherein the second lever includes a second latch pin disposed on the back end of the second lever that is sized and configured to be received in the notch during the secured engagement.

9. The stored energy stapler of claim 2, wherein the biasing member is disposed adjacent the latch mechanism.

10. The stored energy stapler of claim 1, wherein the pivot point is a second pivot point, and wherein the first lever is pivotally coupled to the base portion about a first pivot point disposed between the second pivot point and the biasing member.

11. The stored energy stapler of claim 1, wherein the base portion includes an anvil along a top surface of the base portion and two sidewalls extending from the top surface, each of the sidewalls having three apertures, and wherein the stapler includes three pivot pins extending through the apertures in the sidewalls, one of the pivot pins defining the first pivot point and another of the pivot pins defining the second pivot point.

12. The stored energy stapler of claim 1, further comprising a magazine pivotally coupled to the second lever about the pivot point, the magazine sized and configured to hold staples.

13. The stored energy stapler of claim 12, wherein the magazine includes a first component pivotally coupled to the second lever, and a second component pivotally coupled to the first component.

14. The stored energy stapler of claim 13, wherein the second component is a protruding flange along a back end of the magazine.

15. The stored energy stapler of claim 13, wherein the magazine includes a third component slidably coupled to the first component and releasably coupled to the second component.

16. The stored energy stapler of claim 15, wherein the biasing member is a first biasing member, and wherein the second component is rotationally biased by a second biasing member into engagement with the third component.

17. The stored energy stapler of claim 16, wherein the second component includes an engaging member and the first component includes a notched portion, and wherein the biasing member biases the engaging member into the notched portion.

18. The stored energy stapler of claim 15, wherein the stapler includes an activation member sized and configured to engage the second component to release the third component from the second component.

19. A stored energy stapler comprising:

a base portion sized and configured to rest on a flat surface;

a top lever pivotally coupled to the base portion about a first pivot point, the top lever including a first latch pin at a back end of the top lever;

a striker lever pivotally coupled to the base portion about a second pivot point, the striker lever having a striker element at a front end of the striker lever and a second latch pin at a back end of the striker lever;

a staple magazine pivotally coupled to the striker lever about the second pivot point, the staple magazine sized and configured to hold a plurality of staples to be driven out of the stapler by the striker element;

a biasing member coupled to both the back end of the striker lever and the back end of the top lever that biases the back ends of the striker lever and the top lever apart from one another; and a latch mechanism pivotally coupled to the base portion for rotation between a secured position and a released position, the latch mechanism including a cam surface sized and configured to be engaged by the first latch pin to move the latch mechanism into the released position, and a notch for holding and retaining the second latch pin when the latch mechanism is in the secured position.

20. The stored energy stapler of claim 19, further comprising a torsion spring that biases the latch mechanism toward the secured position.

21. The stored energy stapler of claim 19, wherein the second pivot point is disposed between the striker element and the biasing member.

22. A stored energy stapler comprising:

a base portion;

a first lever pivotally coupled to the base portion, the first lever having a front end and a back end;

a second lever pivotally coupled to the base portion about a pivot point, the second lever having a front end and a back end, and a striker element at the front end for driving a staple out of the stapler;

a biasing member coupled to both the first lever and the second lever; and a latch mechanism coupled to the base portion and the second lever to selectively prevent rotation of the second lever about the pivot point;

wherein the pivot point is disposed between the striker element and the biasing member.

* * * * *